United States Patent [19]

Mott et al.

[11] Patent Number: 4,576,358

[45] Date of Patent: Mar. 18, 1986

[54] REMOTELY OPERABLE SAFETY VALVE

[75] Inventors: James D. Mott, Houston; Danny K. Wolff, Cleveland, both of Tex.

[73] Assignee: Hydril Company, Los Angeles, Calif.

[21] Appl. No.: 486,909

[22] Filed: Apr. 20, 1983

[51] Int. Cl.[4] ..... F16K 31/143

[52] U.S. Cl. ..... 251/14; 251/58; 251/62; 251/77; 166/319

[58] Field of Search ..... 251/31, 58, 14, 292, 251/248, 77, 62, 63.4; 166/319, 332; 91/415

[56] References Cited

U.S. PATENT DOCUMENTS

| | | | |
|---|---|---|---|
| 2,340,999 | 2/1944 | Trott | 251/14 X |
| 2,352,140 | 6/1944 | Trott | 251/14 X |
| 2,390,882 | 12/1945 | Hopkins | 251/104 X |
| 2,843,093 | 7/1958 | Vitausky | 91/415 X |
| 3,509,913 | 5/1970 | Lewis | 251/58 X |
| 3,610,568 | 10/1971 | Duwe | 251/58 |
| 3,698,617 | 10/1972 | Fulzaya et al. | 91/415 X |
| 3,806,082 | 4/1974 | Kellner | 251/58 |
| 3,887,161 | 6/1975 | Kubelka | 251/58 |
| 3,941,348 | 3/1976 | Mott | 251/58 |
| 4,182,219 | 1/1980 | Baatrap | 91/415 X |

*Primary Examiner*—Larry Jones
*Assistant Examiner*—Carl D. Price
*Attorney, Agent, or Firm*—Dodge, Bush & Moseley

[57] ABSTRACT

An improved remotely operable safety valve which is adapted for use between the swivel and the kelly is disclosed. An annular hydraulic piston moves the valve to the open and closed position whether or not the drill string is rotating, and in the event of hydraulic failure, the valve may be operated manually. Centering spring means are provided to reduce wear on the operable elements when the valve is in the open position.

16 Claims, 6 Drawing Figures

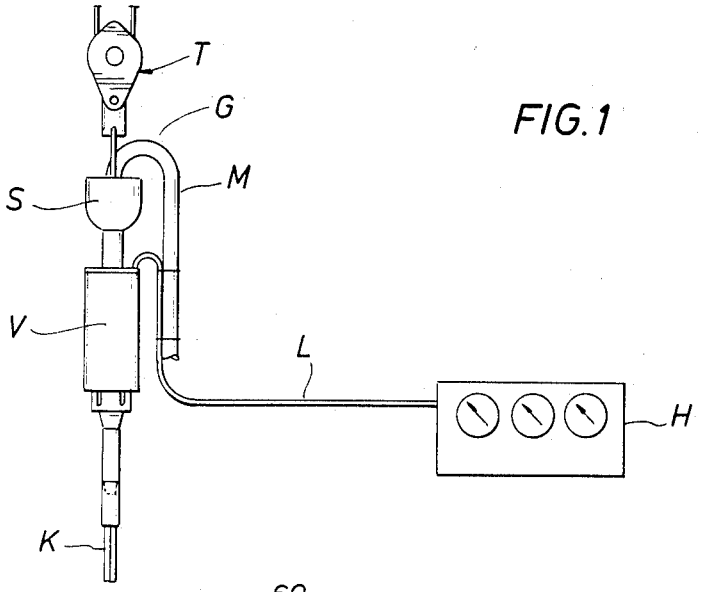
FIG. 1
FIG. 4
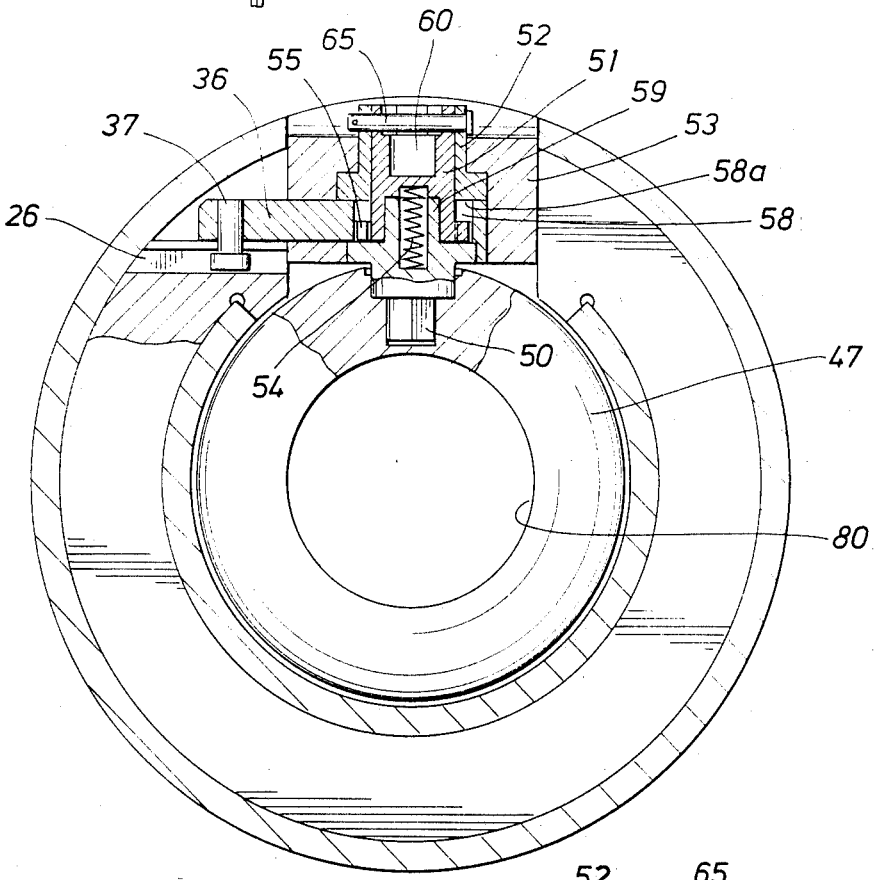
FIG. 5
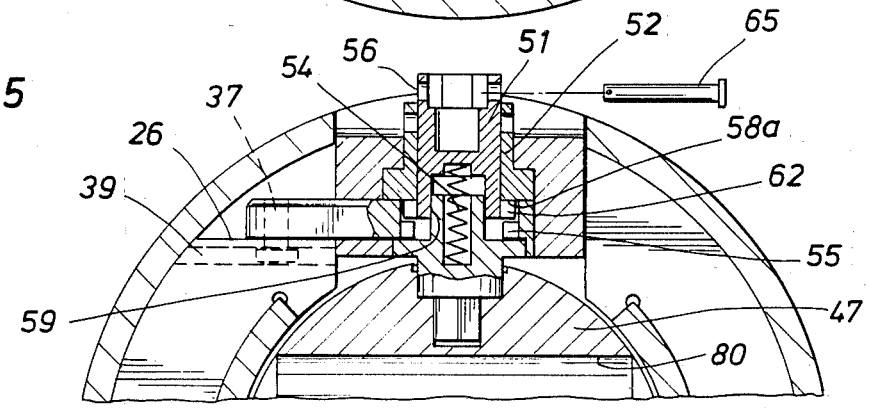

REMOTELY OPERABLE SAFETY VALVE

BACKGROUND OF THE INVENTION

1. Field of the Invention

This invention relates in general to apparatus used in the drilling of oil and gas wells. In particular, the invention relates to remotely controllable safety valves for controlling flow through rotatable tubular members and means for manually controlling the valve by a remote power source.

2. Description of the Prior Art

During modern rotary drilling operations, drilling mud is pumped from the mud pumps at the drilling platform, through the swivel, the rotating kelly, and the rotating drilling string, in order to sweep or wash away cuttings from the drilling bit and return them via the annulus between the string and the well bore to the surface in a manner well known. In the event of a sudden increase in downhole pressure, such as from a kick, or when a blowout threatens, upward flow through the drilling string and kelly from downhole must be blocked in order to maintain control of the well and prevent drilling mud loss.

Often, valves are mounted above and below the kelly in order to shut off flow through the kelly and the drilling string. Such valves, sometimes referred to as "kelly cocks", have been designed to be manually rotated to a closed position by a special tool.

Occasionally, it is necessary to close off flow through the kelly under emergency conditions such as, for example, the occurrence of an offshore platform fire. In such an emergency situation, it may be impossible for an operator to physically be close enough to the kelly cock to close the valve manually. Thus, the well continues to flow until it can be shut in by other means which can be costly to the ecology of the area and costly economically. In addition, under blowout or downhole increased pressure conditions it may be impossible to close the kelly cock because of gases, danger of fire or other reasons.

U.S. Pat. No. 3,941,348 to Mott, one of the inventors of the present invention, discloses a remotely operable safety valve mounted between the swivel and the kelly in drilling operations including a spherically-shaped valve element which is mounted in a generally tubular housing rotatable with the swivel sub, the kelly and the drill string. Hydraulic means move the valve element between open and closed positions in order to control flow through the drill string and prevent in-line blowouts. As an additional safety feature, spring means move the valve element to a closed position in the event of a failure of the hydraulic means.

It is an object of the present invention to provide an improved safety valve to that disclosed in the above mentioned patent.

It is another object of the invention to provide a safety valve having automatic centering of cam follower bearings between two operating positions to prevent wear of the bearings that would otherwise occur if they were constantly bearing against an actuating surface as the kelly rotates.

Still another object of the invention is to provide for manual operation of the valve if the remote power source normally controlling the valve were to fail.

SUMMARY OF THE INVENTION

A remotely operable in-line safety valve is mounted below the swivel in order to shut off flow from below before it reaches the swivel. The in-line safety valve includes a stationary housing attached to the swivel and an attached rotating housing which rotates with the kelly. Under normal conditions, mud is pumped through the swivel, the inline safety valve and the kelly into the drilling string.

An actuating sleeve is mounted concentrically outwardly of the rotating housing for slidable movement with respect thereto. A crank is operably connected between the actuating sleeve and a valve element mounted in the bore of the rotating housing such that vertical movement of the actuating sleeve translates pivotal movement to the crank causing the valve element to rotate thereby closing the bore in the rotating housing. Hydraulic means are provided to move the actuating sleeve, pivot the crank and cause the valve element to close. A remote hydraulic power source and conduits coupled to the stationary housing allow operation from a remote location while the kelly is rotating.

The hydraulic means includes an annular piston mounted within the stationary housing section. The annular piston exerts a downward or upward force to cam follower bearings attached to the lower end of the annular piston. The cam follower bearings urge the actuating sleeve downward or upward to open or close the valve.

When the saftey valve is open, cam follower bearing centering spring means, advantageously positioned between the stationary housing and the rotatable housing, urge the cam follower bearing to a non-engaging position with respect to the actuating sleeve. When the valve is put in the open position, hydraulic lines to the annular piston are vented, and the centering spring means urge the cam follower bearings and the piston slightly upward thereby disengaging of the cam follower bearings from the actuating sleeve. Disengagement of the cam follower bearing eliminates wear when the valve is open and greatly extends the life of the bearings and the actuating sleeve, because in normal operations the valve is open far more than it is closed.

The valve shaft assembly is advantageously equipped for manual operation should the hydraulic power source fail. The valve shaft assembly contains a safety pin. When the pin is removed, the hydraulic controls of the safety valve are operably disconnected. The valve may then be opened or closed by the use of a wrench inserted into the shaft box of the shaft assembly.

BRIEF DESCRIPTION OF THE DRAWINGS

The foregoing summary of the invention and other objects and advantages of the invention will be described in more detail below taken in conjunction with the accompanying drawings in which:

FIG. 1 is a schematic view illustrating the safety valve of this invention mounted above the kelly used in the drilling of an oil or gas well;

FIG. 4 is a cross section of the valve which shows the valve shaft assembly which enables emergency manual operation of the valve;

FIG. 5 illustrates the valve shaft assembly after removal of a safety pin enabling manual operation of the valve.

DESCRIPTION OF THE INVENTION

With reference to FIG. 1, the letter V generally designates an in-line safety valve of this invention mounted for operation and use below a swivel S used in the drilling of an oil or gas well. The swivel S is suspended from a travelling block T in a manner typical of well drilling operations. The safety valve V is mounted below the swivel S and above kelly K whereby a portion of the valve V rotates with the kelly K and the drilling string (not shown) during normal drilling operations. During such normal drilling operations, drilling mud is pumped through a mud line M, through the goose neck G attached thereto, through the swivel S and the safety valve V of this invention, through the kelly K and into the drilling string (not shown) which is attached to the kelly K. Hydraulic power source means H is disposed at a location remote from the drilling string and is connected to safety valve V via conduit means L.

Figure 2:
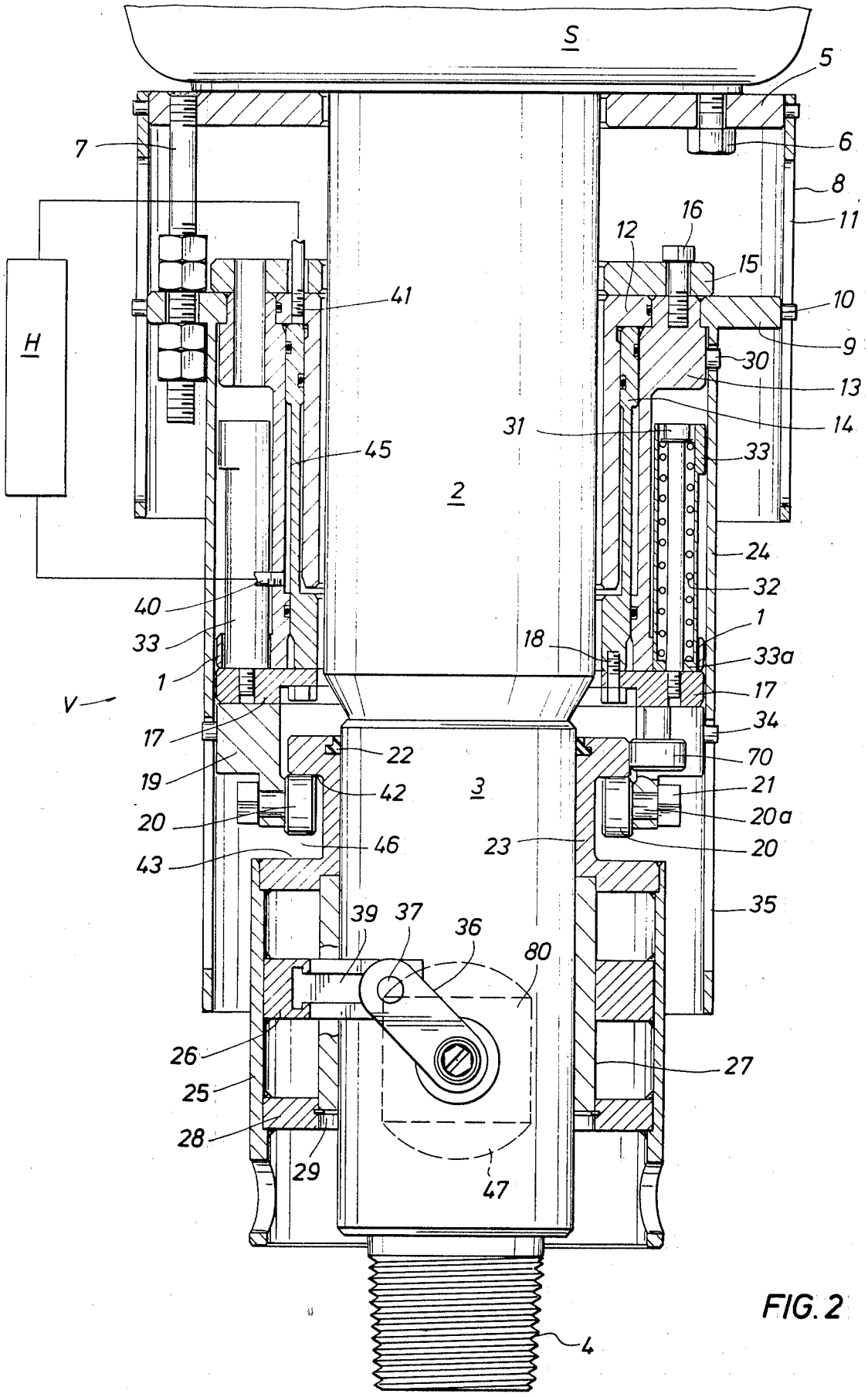
FIG. 2 is a sectional view of the remotely operable valve in the closed position.

Referring to FIG. 2, the safety valve V of the invention is illustrated in the closed position below the swivel S and above the kelly K (not shown in FIG. 2). The stationary housing section of safety valve V is attached to swivel S by swivel plate bolts 6 through swivel plate 5. Upper cover sleeve 8 is used to protect and to orient the parts located below it. Stationary housing assembly support plate 9 is mounted below swivel plate 5 by bolts 7. Slot 11 is provided in the cover sleeve 8 to engage bolts 10 attached to plate 9 to insure proper orientation of the stationary housing parts. Inner cylinder 12 and outer cylinder 13 are mounted on stationary housing assembly support plate 9 by the use of piston support plate bolts 16 attached to piston support plate 15. Annular piston 14 is disposed in the annular space between inner cylinder 12 and outer cylinder 13.

Hydraulic port 41 through inner cylinder 12 provides hydrualic fluid communication with the head of piston 14. Pressurized hydraulic fluid applied through port 41 urges piston 14 downward. Hydraulic port 40 disposed in the wall of outer cylinder 13, provides hydraulic fluid communication to chamber 45 in order to urge piston 14 upward. Piston-bearing plate 17 is attached to annular piston 14 by bolts 18. Bearing support blocks 19 are attached to piston-bearing plate 17 to support cam follower bearings 20.

Cam follower bearings 20 are mounted on bearing support block 19 and secured by threaded attachment of cam follower bearing shaft nut 21 to cam follower bearing shaft 20*a*.

Centering cam roll bearings 70 attached to plate 17 are spaced about the periphery of upper ring 23 and are provided for centering the upper ring 23 disposed about rotating valve housing 3 with respect to plate 17 about rotating housing 2.

The spring assembly, which is attached to piston-bearing plate 17, includes spring retainer bolt 31, coil spring 32 and spring cover 33. Spring retainer bolt 31 extends through the cylindrical interior of spring 32 and is threadably connected into piston-bearing plate 17. Coil spring 32 is compressed between the enlarged head of spring retainer bolt 31 and the projecting lower rim 33*a* of spring cover 33. The spring 32 and spring retainer bolt 31 are located concentrically inward of spring cover 33. The spring cover 33 extends through a hole in retaining lip 1 of outer cylinder 13. When an upward force is exerted on the spring cover 33, the spring 32 is urged upward compressing the spring against the enlarged head of the stationary spring retainer bolt 31.

Figure 3:
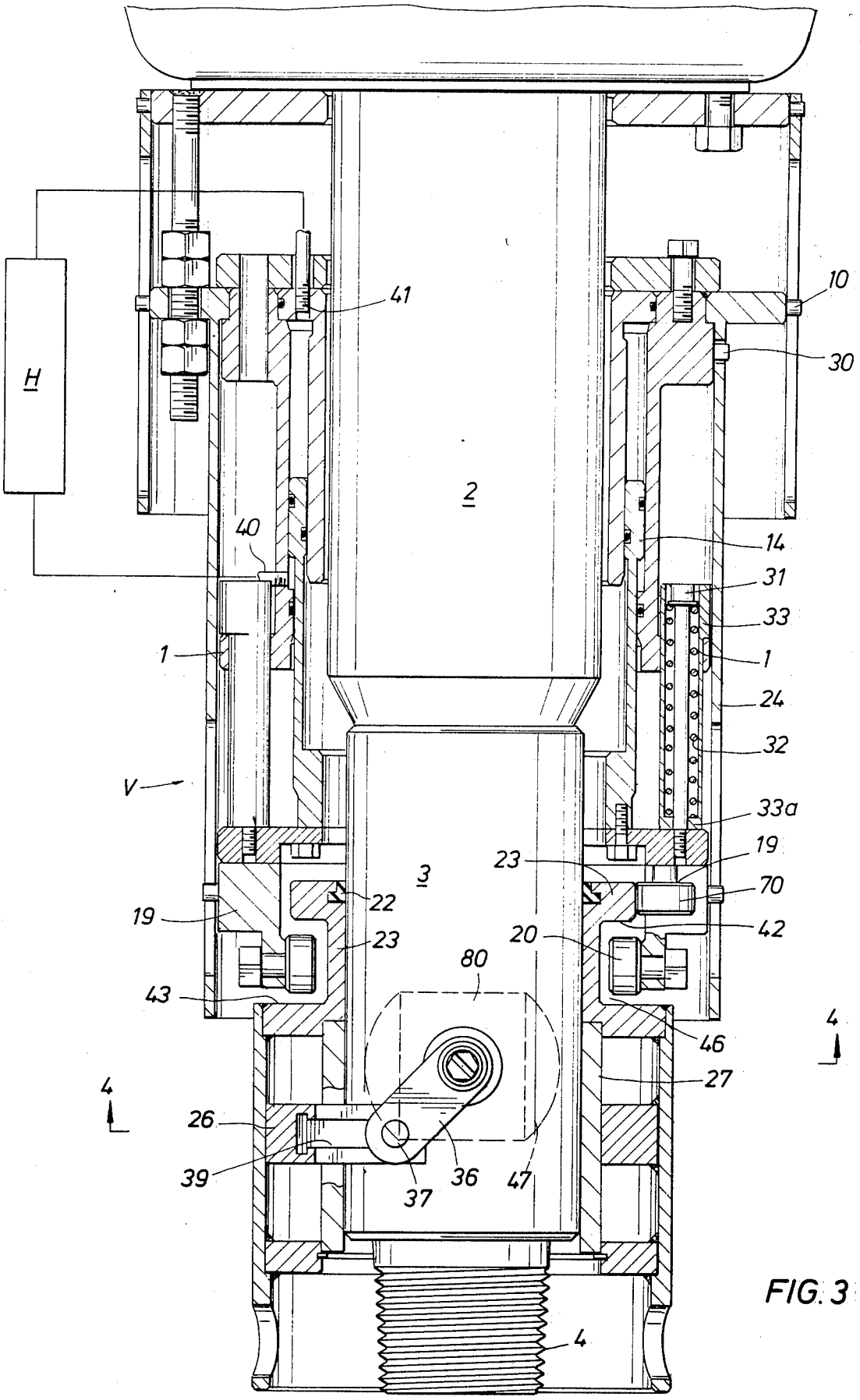
FIG. 3 is a sectional view of the remotely operable valve in the open position illustrating the centered position of the cam follower bearings.

Retaining lip 1 of outer cylinder 13 is disposed concentrically inwardly of middle cover guard 24. A shoulder near the upper end of spring cover 33 engages retaining lip 1 when the spring assembly and piston bearing plate 17 are extended maximally downward. Retaining lip 1 serves to terminate the vertically downward movement of spring cover 33 when the spring assembly and cam follower bearings 30 are near the lower end of their vertical path (see FIG. 3 illustrating the valve in the open position), yet allowing the spring assembly and cam follower bearings 20 to continue downward. Once retaining ring 1 has been engaged with the spring cover 33, further downward movement of the spring assembly and cam follower bearings 20 causes coil spring 32 to be compressed between the enlarged head of the stationary spring retainer bolt 31 and the lower concentrically inwardly projecting lip 33*a* of spring cover 33. When the hydraulic pressures in flow lines to ports 40 and 41 are neutralized, the compressed spring 32 urges the cam follower bearings 20 to the center of the slot 46 of upper ring 23 after the valve has been placed in an open position.

Middle cover guard 24 is attached to the stationary housing assembly by middle cover guard bolts 30 attached to outer cylinder 13. Guide bolts 34 are attached to bearing support block 19, the head of guide bolts 34 extending through middle cover plate slot 35 to guide and align bearing support block 19 during vertical movement as the valve is opened or closed.

The rotatable housing section of valve V is rotatably supported by swivel S. Swivel stem 2 is mounted within swivel S to turn feely while the swivel S remains stationary as it supports the stationary housing section members. The rotatable swivel stem 2 is attached to the valve housing 3. A ball valve 47 is disposed within valve housing 3. A threaded pin member 4 at the bottom of valve housing 3 is provided for attaching the kelly K.

Upper ring 23 is mounted concentrically outward of valve housing 3, which is secured by upper bearing ring 22 and lower bearing ring 27. A slot 46 disposed concentrically outward from upper ring 23 includes an upper surface 42 and a lower surface 43 for bearing contact with cam follower bearing 20. Lower plate 28 is concentrically outward of lower bearing ring 27 and lower bearing ring 27 is mounted thereto by retainer ring 29. Link 26 is disposed between lower plate 28 and upper ring 23 and is fixedly mounted concentrically outward of lower bearing ring 27. The lower plate 28, link 26 and the lower portion of upper ring 23 are fixedly attached to lower cover sleeve 25 which, with upper ring 23, form an actuating sleeve.

Link 26 is disposed concentrically inward of lower cover plate 25. An outwardly disposed slot 39 is provided in link 26. A crank pin 37 fixably attached at one end of crank 36 of ball valve 47 slides within slot 39 of link 26 during opening and closing of the valve. FIG. 4 illustrates the crank arm 36, pin 37 and link 26 in a section through ball valve 47 and link 26.

Figure 6:
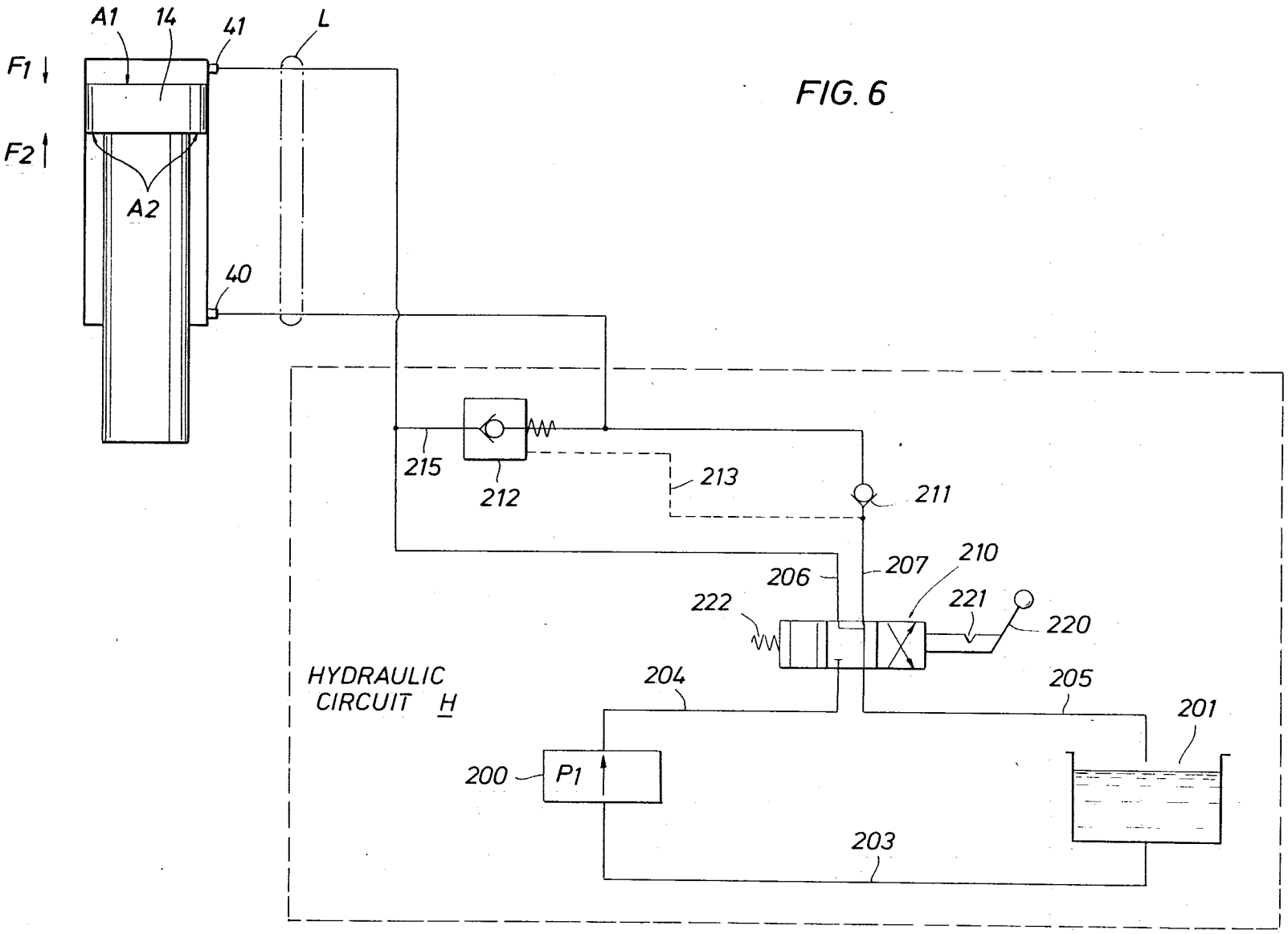
FIG. 6 illustrates schematically the hydraulic circuit for remotely controlling the safety valve.

FIG. 6 illustrates schematically the hydraulic circuit provided for forcing piston 14 downwardly thereby opening ball valve 47 (as illustrated in FIG. 3) and for forcing piston 14 upwardly thereby closing ball valve 47 (as illustrated in FIG. 2). A source of regulated hydraulic pressurized fluid 200 is connected to a hydraulic fluid drain tank 201 by a suction line 203. A spring centered three position four way valve 210 is connected between lines 204 and 205 from source 200 and drain tank 201 and lines 206 and 207. Check valve 211 is provided in line 207 leading to port 40. Line 206 is applied directly to port 41. A pressure controlled check valve 212 is provided in a line 215 between ports 41 and 40. Line 213 between line 207 serves as a pilot control line for check valve 212.

The piston 14 is preferably constructed such that area $A_1$ on the top of the piston is approximately twice the area $A_2$ beneath the piston 14. That is, pressure, for example $P_1$, applied to the top of the piston via port 41 exerts an opening force $F=P_1A_1$, at the top of the piston. Pressure $P_1$ applied beneath piston 14 via port 40 exerts a restoring force $F_2=P_1A_2$.

When valve 210 is in its centered position, no pressure from source 200 is applied to piston 14 and fluid from port 41 drains to tank 201 via lines 206. When handle 220 is pulled out from valve 210, pressure $P_1$ from source 200 is applied via line 206 and check valve 212 to both ports 41 and 40. Thus a force at the top of the piston 14 is applied of an amount $F_1=P_1A_1$ and a force beneath piston 14 is simultaneously applied of an amount $F_2=P_1A_2$. Since $A_1=2A_2$, $F_1=2P_1A_2$. Thus the resulting force on piston 14 is $F_1-F_2=(2P_1A_2)-(-P_1A_2)$ or opening force $F_0-F_1-F_2=P_1A_2$ in a direction tending to open the piston.

After the piston 14 is open and ball valve 47 is moved to the position illustrated in FIG. 3, handle 220 is released and valve 210 returns to the centered position under the urging of spring 221. Thus opening force on piston 14 is relieved because of the fluid drain from port 41 to tank 201. FIG. 3 illustrates the valve in an open condition after annular piston 14 has been urged downward and then urged a relatively small distance upward by the spring 32. Crank arm 36 has been moved to a downward position such that bore 80 of ball valve 47 is aligned with the axis of the valve V to allow drilling fluid to pass during normal drilling operations. Cam follower bearings 20 have been urged by spring 32 to a non-engaging position within slot 46 after the pressurized hydraulic fluid is no longer applied to ports 41 and 40.

Returning again to FIG. 6, when handle 220 is urged inwardly, valve 210 is moved to the third position such that pressurized hydraulic fluid from line 204 is applied to line 207 and via check valve 211 to port 40 for application of pressurized fluid beneath piston 14. Detent 221 maintains valve 210 in a closed position until an operator again pulls handle 220. Pilot controlled check valve 212 responding to pressurized fluid via control line 213 prevents fluid from passing in either direction in line 215. Fluid from port 41 drains to tank 201 via lines 206 and valve 210 which connects line 206 to line 205. The closing force beneath piston 14 is $F_c=F_2=P_1A_2$.

Thus it is seen that the opening and closing forces, $F_o$ and $F_c$ are substantially the same on piston 14 because of the geometry provided above and beneath piston 14 and because of the hydraulic circuitry provided, even though a hydraulic pressure source of constant pressure output is provided. Substantially equal opening and closing forces acting on the linkages to the ball valve 47 contribute to reliability and long cycle life essential to rugged oil drilling conditions.

Referring now to FIGS. 4 and 5 illustrating a section of the valve V through the ball valve 47 and link 26, crank spline 55 secures the crank 36 to the shaft box 51 by engagement with the shaft box external spline 62 disposed on the lower rim of shaft box 51. Shaft box 51 is slidably mounted over the outer portion of shaft pin 50 and is rotatably fixed thereto by hexagonal connection 59. Shaft pin 50 is secured to ball valve 47.

The external box end of shaft box 51 is designed to accept the pin of a manually operated wrench (not shown). The shaft box 51 is held in place by the shaft box stop 52 through which safety pin 65 is inserted near its outer rim. During normal operation of the valve V, that is by remote operation and control from hydraulic power source H, pin 65 extending through shaft box stop 52 via the aligned safety pin holes 56 maintain shaft box 51 in position. Shaft box stop 52 is concentrically outwardly surrounded and guided by valve shaft assembly cover plate 53. Shaft pin spring 54 is disposed between shaft pin 50 and shaft box 51 and acts to urge shaft box 51 away from shaft pin 50.

During manual operation, the shaft box 51 is held in place by contact of the external shaft box spline 62 with shoulder **58*a* of shaft box stop 52. Spline space 58 is provided for upward movement of external shaft box spline 62. While in manual operation position, shaft pin 50 remains rotatably fixed to shaft box 51 even though its connection surface area with hexagonal surface 59** is reduced.

Operation

Referring again to FIG. 1, during normal drilling operations in an oil or gas well, drilling mud is pumped through the goose neck G, the swivel S, the swivel stem 2, and the valve housing 3 of the valve V of this invention, through the kelly K and into the drilling string (not shown) in order to lubricate the bit and carry away borehole cuttings. When it is desired to close the valve V, such as when a kick or a blowout threatens, the valve V is actuatable from a remote location.

To close valve V, remote hydraulic fluid source H applies pressurized hydraulic fluid through port 40 while connecting port 41 to a hydraulic drain as illustrated in FIGS. 2, 3 and 6. Fluid pressure applied to port 40 forces annular piston 14 to move upwardly in its annular cylinder 45 from the open position illustrated in FIG. 3. The closing force is approximately equal to the pressure applied beneath piston 14 times the pressure of the hydraulic fluid applied. Upward movement of piston 14 causes bearing block 19 to move upward. The cam follower bearings 20, which are attached to bearing support block 19, are forced upward making contact with the upper surface 42 of upper ring slot 46. After the cam follower bearing 20 makes contact with upper surface 42 of upper ring slot 46, piston 14 continues to move upward forcing lower bearing ring 27 to slide upwardly along the exterior of valve housing 3. Valve housing 3 and lower bearing ring 27 and attached mechanism thereto may be rotating or not with respect to stationary cam follower bearings 20 during opening or closing of the vertical flow path of the valve.

As the lower bearing ring 27 is moved upward with respect to the valve housing 3, link 26 also moves upward causing the slidably attached crank pin 37, which is fixably attached to the end of crank 36, to move within the linear slot 39 in link 26. This cam-type action causes the crank arm 36 to pivot in a clockwise direction transmitting a rotational force to the internal crank spline 55 illustrated in FIGS. 4 and 5. When in its remotely operable condition, the internal crank spline 55 transmits rotational movement via external shaft box spline 62 to the shaft pin 50. Rotation of shaft pin 50 causes the ball valve 47 to rotate to the closed position. Although the valve element 47 is preferably a ball valve, any suitable valve element may be substituted therefor.

To open the valve, pressurized hydraulic fluid applied to fluid ports 41 and 40 causes the annular piston 14 to move downwardly. Since the area on top of piston 14 is approximately twice the area beneath piston 14, the piston 14 is urged downwardly with an opening force approximately equal to the closing force. The bearing support block 19 connected to the piston 14 moves downwardly causing cam follower bearing 20 to contact the lower surface 43 of upper ring slot 46. As the piston 14 continues downwardly, the lower bearing ring 27 and the link 26 are urged downwardly along the valve housing 3. The link 26 consequently causes crank arm 36 to move in a counterclockwise direction, causing the valve element 47 to open the vertical flow path of the drilling string. Spring means 32 causes cam follower bearings 20 to become centered in slot 46 after fluid pressure to ports 40 and 41 is removed.

Emergency Operation

If the remotely located hydraulic fluid source H were to fail, the apparatus according to the invention may be manually operated. The operator approaches the valve housing 3. Safety pin 65 is removed from the safety pin hole 56 which passes through shaft box 51 and the shaft box stop 52. Upon removal of the safety pin 65, the shaft box 51 is urged away from shaft pin 50 by means of valve pin spring 54. This causes the external shaft box spline 62 to disengage from the internal crank spline 55. The external shaft box spline 62 moves into spline space 58 as the shaft box 51 is urged away from the shaft pin 50. Once the splines are disconnected, crank arm 36 is disabled, and indeed prevented during an emergency situation from translating a rotational force to the shaft pin 50. An operator may then insert a wrench into the shaft box socket 60 and rotate the shaft box 51. The shaft box 51 remains operably connected to the shaft pin 50 by hexagonal connection 59 thereby allowing the shaft box 51 to rotate shaft pin 50. Shaft pin 50 rotates ball valve 47 causing the flow path to close or open.

Various modifications and alterations in the described apparatus will be apparent to those skilled in the art from the foregoing description which does not depart from the spirit of the invention. The foregoing disclosure and description of the invention are illustrative and explanatory thereof and details of the illustrative embodiment may be made without departing from the spirit of the invention.

What is claimed is:

1. An improved remotely operable valve for controlling fluid flow through a rotating tubular member having, a stationary housing, a remotely disposed source of pressurized hydraulic fluid, a tubular rotatable housing, having a flow passage formed therein, which is rotatably mounted with respect to the stationary housing section, valve means mounted within said rotatable housing for controlling fluid flow through said flow passage by rotation of a valve shaft between an open position for enabling fluid flow and a closed position for blocking fluid flow, piston means disposed in said stationary housing and operably connected to said source of hydraulic fluid and connected to a bearing means, an actuating assembly means having a bearing contact surface, said actuating assembly means for operably connecting said stationary housing to said valve shaft in order to open or close the valve means, said actuating assembly means being rotatable with said rotatable housing and mounted for axial movement with respect to said rotatable housing to control said valve, said bearing means connected to said piston means rotatably contacting said bearing contact surface of said actuating assembly means for axially operably moving the actuating assembly, the valve being remotely operable to permit opening or closing of the flow path while enabling relative rotation between the rotatable housing and the stationary housing, wherein the improvement comprises, means for removing said source of pressurized fluid on said piston means after said valve has been opened, and means for automatically preventing contact between the bearing contact surface of the rotating actuating assembly means and the bearing means when the valve is in the open position and said source of pressurized fluid has been removed from said piston means.

2. The improvement of claim 1 wherein the preventing means comprises, spring means for urging the bearing means away from the bearing contact surface of the actuating assembly means when the valve is in the open position.

3. The improvement of claim 2 wherein the spring means comprises, a coil spring, a threaded rod extending axially through the spring, the rod having head means for confining the spring at one end, the rod being threadably engaged at its other end with means connected to the piston means and the bearing means, spring cover means disposed about the spring, and confining the spring at its end opposite from that confined by the rod head means, said spring cover having a shoulder disposed near the rod head means, retainer ring means disposed in the stationary housing for engagement with the spring cover shoulder after said piston means moves in a direction to open said valve means, wherein the spring, rod and cover move axially with the piston means during opening of the valve means until the spring cover shoulder engages the retainer ring, whereby the spring cover is stopped from further axial movement while the rod continues to move axially in connection with the piston and bearing means until the valve means is fully open whereby the spring is compressed between the head means of the rod and the spring cover means, and wherein said compressed spring acts to urge said bearing means away from contact with the rotating housing when the valve is in the open position.

4. The improvement of claim 1 wherein the piston means is an annular hydraulic piston disposed about the rotatable housing and is adapted for axial movement in a chamber within the stationary housing.

5. The improvement of claim 4 wherein the annular hydraulic piston means has an area on a top surface approximately twice the area on a lower surface and wherein the source of pressurized fluid is a source of substantially constant hydraulic fluid pressure and is applied to the top and lower surfaces of the piston means for opening the valve and is applied only to the lower surface of the piston means for closing the valve, whereby the piston means moves axially for opening and closing the valve with approximately equal force.

6. A valve for controlling fluid flow through a rotating tubular member comprising, a stationary housing, a remotely disposed source of pressurized hydraulic fluid, means for transmitting said hydraulic fluid to said stationary housing, a rotatable housing having a flow passage formed therein, which is rotatably mounted with and capable of rotation with respect to said stationary housing, valve means including a valve shaft pin, the valve means mounted within the rotatable housing for controlling fluid flow through the flow passage, a hydraulically powered actuating assembly means operably connected to said source of hydraulic fluid, said hydraulically powered actuating assembly means including a piston means connected to a bearing means, said bearing means arranged to engage a rotatable bearing surface contact means of a valve shaft assembly means for operably connecting said stationary housing with said valve shaft assembly means for moving said shaft pin of the valve means to an open or to a closed position, said valve shaft assembly means being rotatable with said rotatable housing section and mounted for axial movement with respect to said rotatable housing to control the valve means, said valve shaft assembly means operably connected to said valve shaft pin to move said valve means between an open position for enabling fluid flow and a closed position for blocking fluid flow, and means for removing said source of pressurized fluid on said piston means after said valve has been opened, means for automatically preventing engagement between said rotatable bearing surface contact means and said bearing means when the valve means is in the open position and said source of pressurized fluid has been removed from said piston means, and means for disconnecting said valve shaft assembly means from said valve means and enabling manual operation of said valve means.

7. The valve of claim 6 wherein said valve shaft assembly means comprises link means operably connected to a valve shaft crank arm means, actuating sleeve means connected to the link means for urging the link between a first position and a second position, and means for releasably coupling said valve shaft crank arm means to said shaft pin of said valve means.

8. The valve of claim 7 wherein one end of said shaft pin is rotatably connected to the valve element of the valve means, the other end of the shaft pin being slidably attached and rotatably engaged to a shaft box, the shaft pin having a spring mounted therewith and engaging said shaft box acting to urge the shaft box away from the shaft pin, and wherein said means for releasably coupling said valve shaft crank arm means to said shaft pin includes, a shaft box stop means mounted concentrically outward of the shaft box for terminating movement of the shaft box away from the shaft pin, a first spline attached to the shaft box adjacent the end of the shaft box which slidably abuts the shaft pin, a second spline connected to the crank arm means and concentrically engaging the first spline attached to the shaft box, the engagement of the first and second splines coupling the crank arm means to the shaft pin.

9. The valve of claim 8 wherein the disconnecting and enabling means comprises, tool engaging means provided in the end of the shaft box, a safety pin through complementary holes in the shaft box stop and the shaft box whereby the spring mounted in the spring pin is ineffective in causing the shaft box from moving away from the shaft pin and maintains the engagement of the first and second splines coupling the crank arm means to the shaft pin, and whereby when said safety pin is removed, said shaft box is urged outwardly by said spring until said first and second splines are disengaged, and said shaft box is prevented from further outward movement by said shaft box stop, and whereby, a tool adapted to engage said tool engaging means may be manually used to turn said shaft box thereby opening or closing said valve.

10. An improved remotely operable valve for controlling fluid flow through a rotating tubular member, a stationary housing, a remotely disposed source of pressurized hydraulic fluid, a tubular rotatable housing, having a flow passage formed therein, which is rotatably mounted with respect to the stationary housing section, valve means mounted within said rotatable housing for controlling fluid flow through said flow passage by rotation of a valve shaft between an open position for enabling fluid flow and a closed position for blocking fluid flow, piston means disposed in said stationary housing and operably connected to said source of hydraulic fluid and connected to a bearing means, an actuating assembly means having a bearing contact surface, said actuating assembly means for operably connecting said stationary housing to said valve shaft in order to open or close the valve means, said actuating assembly means being rotatable with said rotatable housing and mounted for axial movement with respect to said rotatable housing to control said valve, said bearing means connected to said piston means rotatably contacting said bearing contact surface of said actuating assembly means for axially operably moving the actuating assembly, the valve being remotely operable to permit opening or closing of the flow path while enabling relative rotation between the rotatable housing and the stationary housing, wherein the improvement comprises, means for removing said source of pressurized fluid on said piston means after said valve has been opened, and means for automatically preventing contact between the bearing contact surface of said rotating actuating assembly and the bearing means when the valve is in the open position and said source of pressurized fluid has been removed from said piston means, and means for disconnecting said valve shaft from the actuating assembly means and enabling manual operation of the valve means.

11. The improvement of claim 10 wherein the preventing means comprises, spring means for urging the bearing means away from the bearing contact surface of said actuating assembly means when the valve is in the open position.

12. The improvement of claim 11 wherein the spring means comprises, a coil spring, a threaded rod extending axially through the spring, the rod having head means for confining the spring at one end, the rod being threadably engaged at its other end with means connected to the piston means and the bearing means, spring cover means disposed about the spring, and confining the spring at its end opposite from that confined by the rod head means, said spring cover having a shoulder disposed near the rod head means, a retainer ring means disposed in the stationary housing for engagement with the spring cover shoulder after said piston means moves in a direction to open said valve means, wherein the spring, rod and cover move axially with the piston means during opening of the valve means until the spring cover shoulder engages the retainer ring whereby the spring cover is stopped from further axial movement while the rod continues to move axially in connection with the piston and bearing means until the valve means is fully open whereby the spring is compressed between the head means of the rod and the spring cover means, and wherein said compressed spring acts to urge said bearing means away from contact with the rotating housing when the valve is in the open position.

13. The improvement of claim 10 wherein the piston means is an annular hydraulic piston disposed about the rotatable housing and is adapted for axial movement in a chamber within the stationary housing.

14. The improvement of claim 13 wherein the annular hydraulic piston means has an area on a top surface approximately twice the area on a lower surface and wherein the source of pressurized fluid is a source of substantially constant hydraulic fluid pressure and is applied to the top and lower surfaces of the piston for opening the valve and is applied only to the lower surface of the piston means for closing the valve, whereby the piston means moves axially for opening and closing the valve with approximately equal force.

15. A valve for controlling flow through a rotating tubular member comprising, a stationary housing, a remotely disposed source of pressurized hydraulic fluid, means for transmitting said hydraulic fluid to said stationary housing, a rotatable housing having a flow passage formed therein, which is rotatably mounted with and capable of rotation with respect to said stationary housing, valve means including a valve shaft the valve means mounted within the rotatable housing for controlling fluid flow through the flow passage, a hydraulically powered actuating assembly means operably connected to said source of hydraulic fluid, said hydraulically powered actuating assembly means including a piston means connected to a bearing means, said bearing means arranged to engage a rotatable bearing surface contact means of a valve shaft assembly means for operably connecting said stationary housing with said valve shaft assembly means for moving said valve shaft of the valve means to an open or to a closed position, said valve shaft assembly means being rotatable with said rotatable housing section and mounted for axial movement with respect to said rotatable housing to control the valve means, said valve shaft assembly means operably connected to said valve shaft to move the valve means between an open position for enabling fluid flow and a closed position for blocking fluid flow, means for removing said source of pressurized fluid on said piston means after said valve has been opened, means for disconnecting said valve shaft from said valve shaft assembly means and enabling manual operation of the valve means, and means for automatically preventing engagement between said rotatable bearing surface contact means of said actuating assembly means with said bearing means when the valve means is in the open position and said source of pressurized fluid has been removed from said piston means.

16. The valve of claim 15 wherein the preventing means comprises, spring means for urging the bearing means away from the actuating assembly means when the valve means is in the open position, the spring means comprises, a coil spring, a threaded rod extending axially through the spring, the rod having head means for confining the spring at one end, the rod being threadably engaged at its other end with means connected to the piston means and the bearing means, spring cover means disposed about the spring, and confining the spring at its end opposite from that confined by the rod head means, said spring cover having a shoulder disposed near the rod head means, a retainer ring means disposed in the stationary housing for engagement with the spring cover shoulder after said piston means in a direction to open said valve means, wherein the spring, rod and cover move axially with the piston means during opening of the valve means until the spring cover shoulder engages the retainer ring whereby the spring cover is stopped from further axial movement while the rod continues to move axially in connection with the piston and bearing means until the valve means is fully open whereby the spring is compressed between the head means of the rod and the spring cover means, and wherein said compressed spring acts to urge said bearing means away from contact with the rotating housing when the valve is in the open position, the valve shaft assembly means comprises, link means operably connected to a valve shaft crank arm means, actuating sleeve means connected to the link means for urging the link between a first position and a second position, and means for releasably coupling said valve shaft crank arm means to said shaft pin of said valve means, and wherein one end of said shaft pin is rotatably connected to the valve element of the valve means, the other end of the shaft pin being slidably attached and rotatably engaged to a shaft box, the shaft pin having a spring mounted therewith and engaging said shaft box acting to urge the shaft box away from the shaft pin, said means for releasably coupling said valve shaft crank arm means to said pin includes a shaft box stop means mounted concentrically outward of the shaft box for terminating movement of the shaft box away from the shaft pin, a first spline attached to the shaft box adjacent the end of the shaft box which slidably abuts the shaft pin, a second spline connected to the crank arm means and concentrically engaging the first spline attached to the shaft box, the engagement of the first and second splines coupling the crank arm means to the shaft pin, and wherein the disconnecting and enabling means comprises, tool engaging means provided in the end of the shaft box, a safety pin through complementary holes in the shaft box stop and the shaft box whereby the spring mounted in the spring pin is ineffective in causing the shaft box from moving away from the shaft pin and maintains the engagement of the first and second splines coupling the crank arm means to the shaft pin, and whereby when said safety pin is removed, said shaft box is urged by said spring until said first and second splines are disengaged, and said shaft box is prevented from further outward movement by said shaft box stop, and whereby, a tool adapted to engage said tool engaging means may be manually used to turn said shaft box thereby opening or closing said valve.

* * * * *